US008536775B2

(12) United States Patent
Yang

(10) Patent No.: US 8,536,775 B2
(45) Date of Patent: Sep. 17, 2013

(54) FIELD EMISSION LAMP WITH MESH CATHODE

(75) Inventor: Tzung-Han Yang, Taipei (TW)

(73) Assignee: Tatung Company (TW)

( * ) Notice: Subject to any disclaimer, the term of this patent is extended or adjusted under 35 U.S.C. 154(b) by 245 days.

(21) Appl. No.: 13/064,745

(22) Filed: Apr. 13, 2011

(65) Prior Publication Data

US 2012/0176024 A1 Jul. 12, 2012

(30) Foreign Application Priority Data

Jan. 6, 2011 (TW) ..... 100100505 A

(51) Int. Cl.
*H01J 63/04* (2006.01)
*H01J 63/06* (2006.01)
*H01J 1/00* (2006.01)

(52) U.S. Cl.
USPC ..... 313/496; 313/309; 313/310; 313/348; 313/350; 313/351

(58) Field of Classification Search
USPC ..... 313/309, 310, 346 R, 348, 350, 351, 313/495–497
See application file for complete search history.

(56) References Cited

U.S. PATENT DOCUMENTS 5,600,200 A * 2/1997 Kumar et al. ..... 313/346 R
6,008,575 A * 12/1999 Kaftanov et al. ..... 313/484
2006/0267471 A1* 11/2006 Hwang et al. ..... 313/310
2008/0079348 A1* 4/2008 Cheng et al. ..... 313/495

* cited by examiner

*Primary Examiner* — Nimeshkumar Patel
*Assistant Examiner* — Steven Horikoshi
(74) *Attorney, Agent, or Firm* — Bacon & Thomas, PLLC

(57) ABSTRACT

A field emission lamp, capable of increasing the number of electron emitting points thereof, and of increasing the uniformity and the intensity of the light output therefrom by installing a mesh cathode is disclosed. The field emission lamp comprises: an outer shell having an inner surface, a mesh cathode unit surrounded by the outer shell, an anode unit formed on a portion of the inner surface of the outer shell, and a phosphor layer formed on a portion of the anode unit. Wherein, the light generated by the phosphor layer, due to the bombardment of the electrons, can output from the field emission lamp of the present invention, through the outer shell where none of the anode unit is formed thereon.

9 Claims, 7 Drawing Sheets

FIELD EMISSION LAMP WITH MESH CATHODE

CROSS REFERENCE TO RELATED APPLICATION

This application claims the benefits of the Taiwan Patent Application Serial Number 100100505, filed on Jan. 6, 2011, the subject matter of which is incorporated herein by reference.

BACKGROUND OF THE INVENTION

1. Field of the Invention

The present invention relates to a field emission lamp and, more particularly, to a field emission lamp capable of increasing the uniformity and the intensity of the light output therefrom by installing a mesh cathode portion to increasing the number of electron emitting points thereof, and of forming an anode portion on a portion of the inner surface of the outer shell thereof.

2. Description of Related Art

A conventional field emission lamp comprises: a transparent outer shell, an anode portion, a cathode portion, and a phosphor layer. The anode portion and the phosphor layer are formed on an inner surface of the transparent outer shell in sequence. The cathode portion is installed on a central position inside the transparent outer shell. Besides, the operation mechanism of the conventional field emission lamp is: electrons is emitted from the cathode portion, being accelerated by the high potential of the anode portion, then being collided with the phosphor layer formed on the anode portion. At this time, the light generated by the phosphor layer, due to the bombardment of the electrons, must passes through the phosphor layer, the anode portion, and the transparent outer shell, before being output to the exterior of the conventional field emission lamp, for the purpose of illumination.

Moreover, in the conventional field emission lamp, the surface of the cathode portion is a continuous flat surface, such as a flat curving surface of a clavate-shaped cathode portion. When the number of the anode electron emitting points needs to be increase, the area of the field emission surface of the cathode portion (i.e. the surface are of the cathode portion) is required to rise, or, increasing the density of the cathode portion to emit electrons without increasing the surface area of the cathode portion. In the prior art, as the cathode portion is formed by solid metal material, the increasing of the surface area of the cathode portion results in the increasing in the weight of the cathode portion. Thus, the conventional field emission lamp is easily over-weighted, making the supporting pillar thereof be easily broken.

Therefore, a field emission lamp capable of increasing the uniformity and the intensity of the light output therefrom by installing a mesh cathode portion to increasing the number of electron emitting points thereof, and of forming an anode portion on a portion of the inner surface of the outer shell thereof is required by the industry.

SUMMARY OF THE INVENTION

It is one object of the present invention to provide a field emission lamp capable of increasing the uniformity and the intensity of the light output therefrom by installing a mesh cathode portion to increasing the number of electron emitting points thereof. It is another object of the present invention to provide a field emission lamp by forming an anode portion on a portion of the inner surface of the outer shell thereof.

To achieve the object, the field emission lamp of the present invention comprises: an outer shell having an inner surface; a mesh cathode portion surrounded by the outer shell; an anode portion formed on a portion of the inner surface of the outer shell; and a phosphor layer formed on a portion of the anode portion; wherein the light generated by the phosphor layer, due to the bombardment of the electrons, outputs from the field emission lamp through the inner surface of the outer shell where none of the anode portion is formed thereon.

Therefore, since the electron is emitted from the mesh cathode portion of the field emission lamp of the present invention, toward the anode portion thereof, until being collided with the phosphor layer. Then, the phosphor layer generates light due to the bombardment of the electrons. The light outputs from the field emission lamp of the present invention through the inner surface of the outer shell where none of the anode portion is formed thereon. As a result, the light does not need to pass any anode portion or any phosphor layer until the light leaves the field emission lamp of the present invention, and the loss caused by the passage of light through the anode portion or the phosphor layer can be avoided. Thus, the light emitting efficiency of the field emission lamp of the present invention can be increased significantly. Moreover, since the mesh cathode portion can increase the number of electron emitting points, both of the uniformity and the intensity of the light output from the field emission lamp of the present invention can increase.

In addition, the form of the mesh cathode portion is not limited, the shape thereof can be clavate, or has a curving structure, spherical structure or a bowl-like structure. Besides, the material of the phosphor layer is not limited, it can be any conventional fluorescent powder, or any conventional phosphor powder suitable for application. Moreover, for different purpose or responding to different requirement, the phosphor layer can be made by mixing one or more kinds of fluorescent powder, or phosphor powder, for emitting UV light, infrared light, white light, or light of other colors. In addition, the mesh cathode portion can be manufactured in accordance with the curvature of the outer shell, such as a glass tube, and of any size suitable. Besides, as the surface area of the mesh cathode portion is much larger than that of a conventional flat cathode portion, the number of electron emitting points is increased significantly.

Other objects, advantages, and novel features of the invention will become more apparent from the following detailed description when taken in conjunction with the accompanying drawings.

DETAILED DESCRIPTION OF THE PREFERRED EMBODIMENT

Figure 1A:
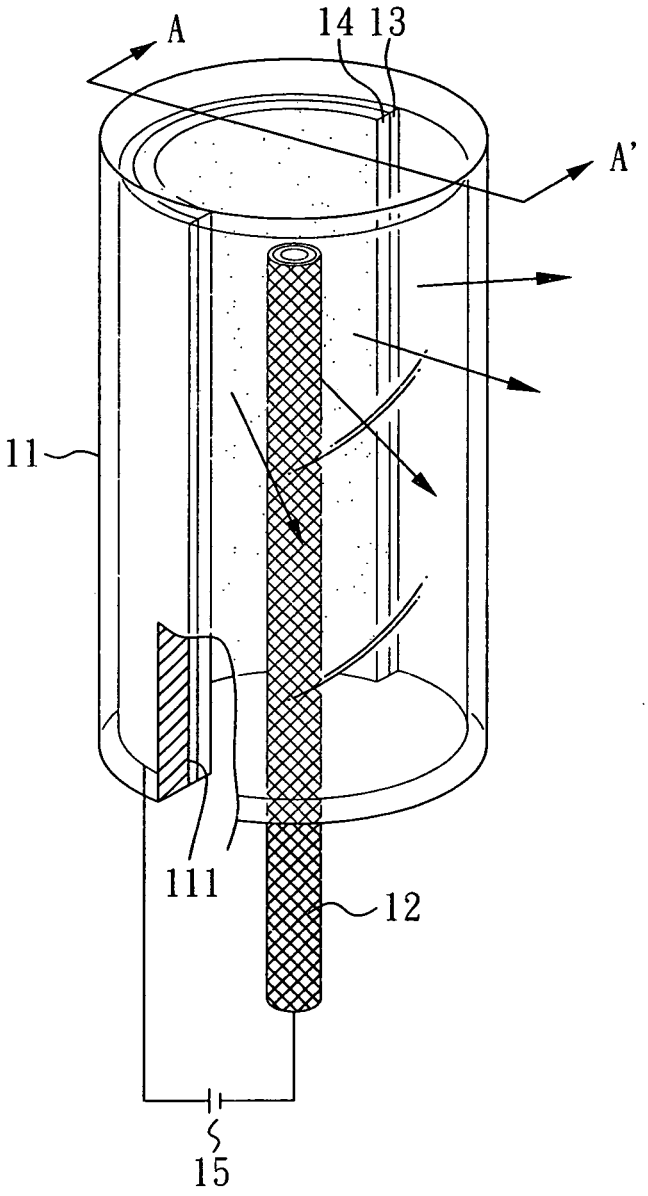
FIG. 1A is a perspective view of the field emission lamp according to first embodiment of the present invention.
Figure 1B:
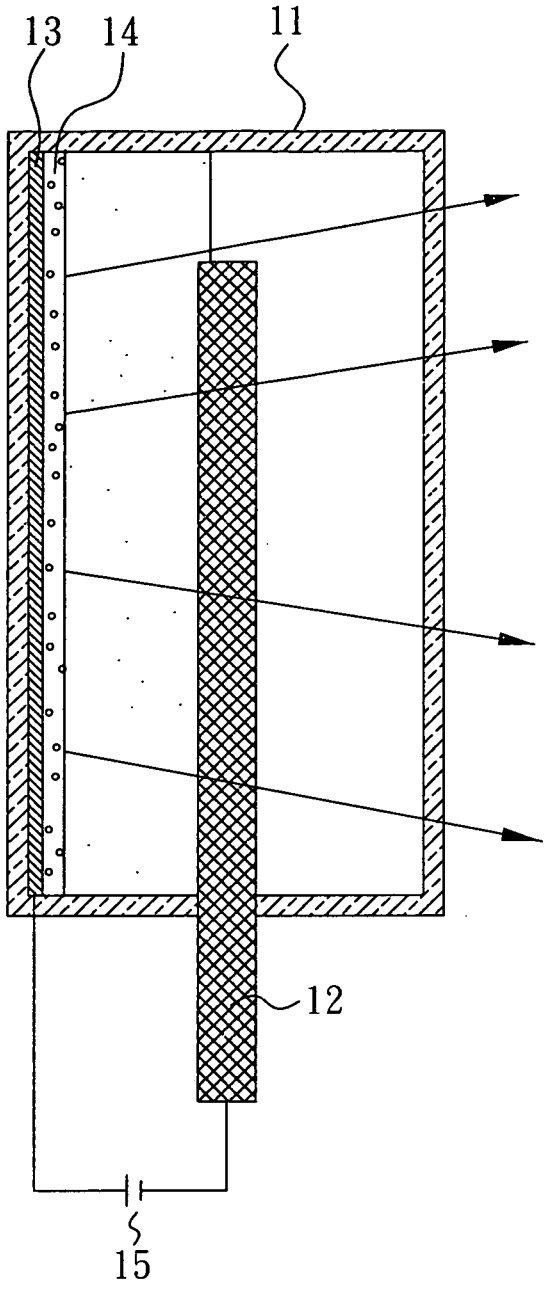
FIG. 1B is a cross-section view taken along the line AA' of FIG. 1A.

With reference to FIG. 1A and FIG. 1B, wherein FIG. 1A is a perspective view of the field emission lamp according to first embodiment of the present invention, while FIG. 1B is a cross-section view taken along the line AA' of FIG. 1A. As shown in FIG. 1A and FIG. 1B, the field emission lamp according to first embodiment of the present invention comprises: an outer shell 11, a mesh cathode portion 12, an anode portion 13, and a phosphor layer 14. Wherein, the outer shell 11 can be formed by a transparent material, for example, a soda-lime glass. Besides, the material of the outer shell 11 can also be soda glass, boron-glass, flint glass, quartz glass, or alkali-free glass. In addition, the outer shell 11 has an inner surface 111, and the light generated by the phosphor layer 14, due to the bombardment of the electrons, outputs from the field emission lamp according to first embodiment of the present invention through the inner surface 111 of the outer shell 11 where none of the anode portion 13 is formed thereon.

Moreover, the shape of the outer shell 11 is tubular, and the mesh cathode portion 12 is surrounded by the outer shell 11. It should be noticed that, the position of the mesh cathode portion 12 is not limited, except for being positioned at the interior of the outer shell 11, and not being directly contacted to the phosphor layer 14, or the outer shell 11. On the other hand, the shape of the mesh cathode portion 12 is clavate in the present embodiment, and the material thereof is metal. The anode portion 13 is formed on half of the inner surface 111 of the outer shell 11, as shown in FIG. 1A. That is, central angle included by the portion where the anode portion 13 is formed thereon is 180 degrees. However, in other application circumstances, the central angle included by the portion where the anode portion 13 is formed thereon maybe other degrees, for example, between 30 degrees and 210 degrees. In addition, the anode portion 13 is a metallic film, for example, aluminum film, nickel film, gold film, silver film, or tin film. At final, the phosphor layer 14 is formed on portions of the surface of the anode portion 13 by spin-coating, for receiving the bombardment of electrons to generate light.

Please refer to FIG. 1A again, after a power source 15 is connected with the anode portion 13 and mesh cathode portion 12 of the field emission lamp according to first embodiment of the present invention, electrons (not shown in the figure) emits from the mesh cathode portion 12 and collides with the phosphor layer 14 formed on portions of the surface of the anode portion 13 for generating light. In addition, as the anode portion 13 is made of metal, the light generated is reflected by the anode portion 13. Then, the reflected light outputs from the field emission lamp according to first embodiment of the present invention through the inner surface 111 of the outer shell 11 where none of the anode portion 13 is formed thereon (as indicated by the arrows of FIG. 1A).

As described above, since the mesh cathode portion can increase the number of electron emitting points, both of the uniformity and the intensity of the light output from the field emission lamp according to first embodiment of the present invention can thus increase. Moreover, since the light generated by the phosphor layer 14 due to the bombardment of electrons can output from the field emission lamp according to first embodiment of the present invention without the need to pass any anode portion or any phosphor layer, the loss caused by the passage of light through the anode portion or the phosphor layer can be avoided. Thus, the light emitting efficiency of the field emission lamp according to first embodiment of the present invention can be increased significantly.

Figure 2:
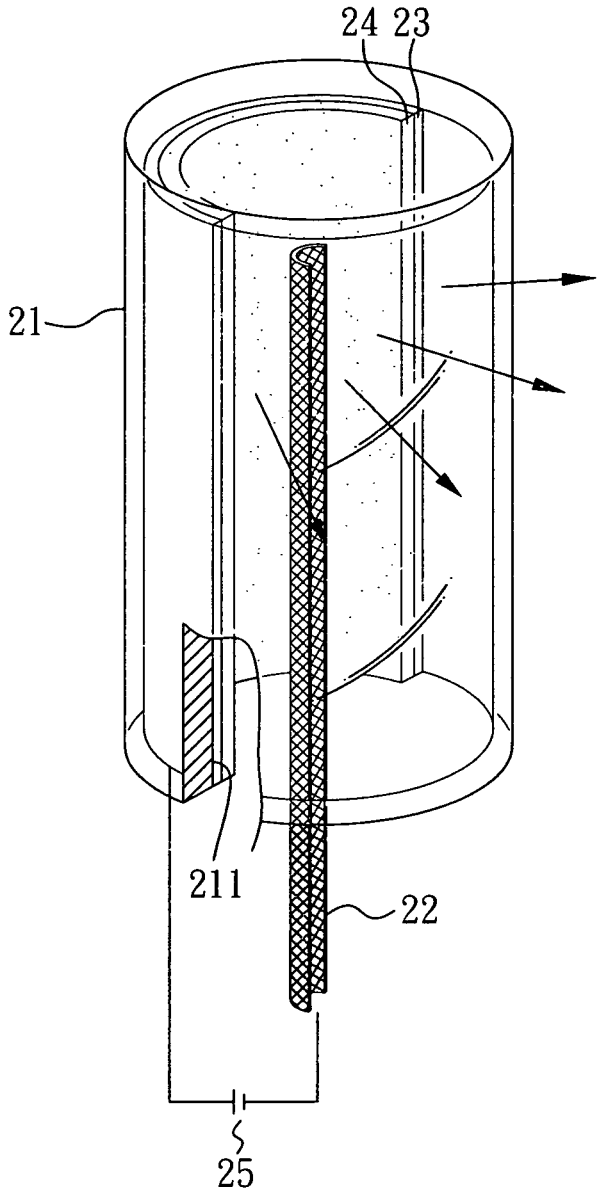
FIG. 2 is a perspective view of the field emission lamp according to second embodiment of the present invention.

With reference to FIG. 2, wherein FIG. 2 is a perspective view of the field emission lamp according to second embodiment of the present invention. As shown in FIG. 2, the field emission lamp according to second embodiment of the present invention comprises: an outer shell 21, a mesh cathode portion 22, an anode portion 23, and a phosphor layer 24. Wherein, the outer shell 21 can be formed by a transparent material, for example, a soda-lime glass. Besides, the material of the outer shell 21 can also be soda glass, boron-glass, flint glass, quartz glass, or alkali-free glass. In addition, the outer shell 21 has an inner surface 211, and the light generated by the phosphor layer 24, due to the bombardment of the electrons, outputs from the field emission lamp according to second embodiment of the present invention through the inner surface 211 of the outer shell 21 where none of the anode portion 23 is formed thereon.

Moreover, the shape of the outer shell 21 is tubular, and the mesh cathode portion 22 is surrounded by the outer shell 21. It should be noticed that, the position of the mesh cathode portion 22 is not limited, except for being positioned at the interior of the outer shell 21, and not being directly contacted to the phosphor layer 24, or the outer shell 21. On the other hand, the shape of the mesh cathode portion 22 has a curving structure and the curving structure faces the anode portion 23, as shown in FIG. 2. That is, the central angle included by the curving structure is 180 degrees. However, in other application circumstances, the central angle included by the curving structure maybe other degrees, for example, between 30 degrees and 210 degrees.

In the present embodiment, the anode portion 23 is formed on half of the inner surface 211 of the outer shell 21, as shown in FIG. 2. That is, the central angle included by the portion where the anode portion 23 is formed thereon is 180 degrees. However, in other application circumstances, the central angle included by the portion where the anode portion 23 is formed thereon maybe other degrees, for example, between 30 degrees and 210 degrees. In addition, in the present embodiment, the anode portion 23 can also be used as a reflective layer, which is a metallic film, for example, aluminum film, nickel film, gold film, silver film, or tin film. At final, the phosphor layer 24 is formed on portions of the surface of the anode portion 23 by film-coating, for receiving the bombardment of electrons to generate light.

Please refer to FIG. 2 again, after a power source 25 is connected with the anode portion 23 and mesh cathode portion 22 of the field emission lamp according to second embodiment of the present invention, electrons (not shown in the figure) emits from the mesh cathode portion 22 and collides with the phosphor layer 24 formed on portions of the surface of the anode portion 23 for generating light. In addition, as the anode portion 23 is made of metal, the light generated is further reflected by the anode portion 23. Then, the reflected light outputs from the field emission lamp according to second embodiment of the present invention through the inner surface 211 of the outer shell 21 where none of the anode portion 23 is formed thereon.

Figure 3:
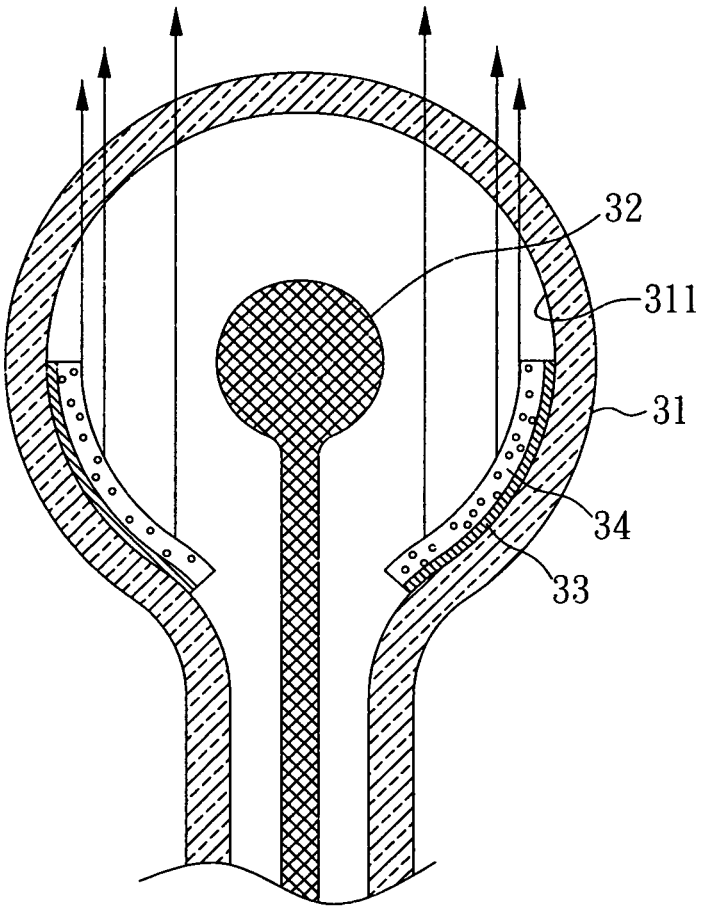
FIG. 3 is a perspective view of the field emission lamp according to third embodiment of the present invention.

With reference to FIG. 3, the field emission lamp according to third embodiment of the present invention comprises: an outer shell 31, a mesh cathode portion 32, an anode portion 33, and a phosphor layer 34. Wherein, the outer shell 31 can be formed by a transparent material, for example, a soda-lime glass. Besides, the material of the outer shell 31 can also be soda glass, boron-glass, flint glass, quartz glass, or alkali-free glass. In addition, the outer shell 31 has an inner surface 311, and the light generated by the phosphor layer 34, due to the bombardment of the electrons, outputs from the field emission lamp according to third embodiment of the present invention through the inner surface 311 of the outer shell 31 where none of the anode portion 33 is formed thereon.

Moreover, the outer shell 31 is a bulb-like shell, and the mesh cathode portion 32 is surrounded by the outer shell 31 and the shape thereof is sphere. Besides, the mesh cathode portion 32 and the anode portion 33 are both made of metal, such as stainless steel, aluminum alloy or nickel alloy. At final, the phosphor layer 34 is formed on portions of the surface of the anode portion 33 by film-coating, for receiving the bombardment of electrons to generate light.

As the structure of the field emission lamp according to third embodiment of the present invention is similar to that of the field emission lamp according to first embodiment of the present invention, and the only difference between them are: the shape of the outer shell (tubular vs. bulb-like shape) and the shape of the mesh cathode portion (clavate vs. spherical), the detail description regarding the operation of the field emission lamp according to third embodiment of the present invention, such as the mechanism of the generation of light, is omitted hereinafter.

Figure 4:
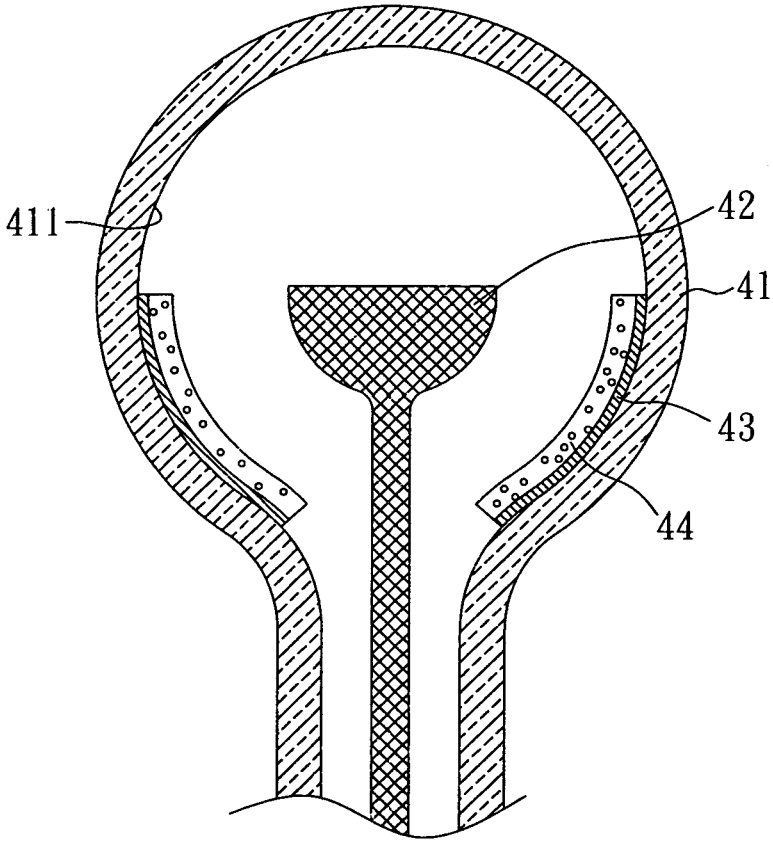
FIG. 4 is a perspective view of the field emission lamp according to fourth embodiment of the present invention.

With reference to FIG. 4, the field emission lamp according to fourth embodiment of the present invention comprises: an outer shell 41, a mesh cathode portion 42, an anode portion 43, and a phosphor layer 44. Wherein, the outer shell 41 can be formed by a transparent material, for example, a soda-lime glass. Besides, the material of the outer shell 41 can also be soda glass, boron-glass, flint glass, quartz glass, or alkali-free glass. In addition, the outer shell 41 has an inner surface 411, and the light generated by the phosphor layer 44, due to the bombardment of the electrons, outputs from the field emission lamp according to fourth embodiment of the present invention through the inner surface 411 of the outer shell 41 where none of the anode portion 43 is formed thereon.

Moreover, the outer shell 41 is a bulb-like shell, and the mesh cathode portion 42 is surrounded by the outer shell 41 and has a bowl-like structure. Besides, the mesh cathode portion 42 is made of metal, such as stainless steel, aluminum, nickel, gold, silver, tin or the alloy thereof. In addition, the opening of the bowl-like structure faces the inner surface 411 of the outer shell 41 where none of the anode portion 43 is formed thereon, as shown in FIG. 4. In the present embodiment, the anode portion 43 can also be used as a reflective layer, which is a metallic film, for example, aluminum film, nickel film, gold film, silver film, or tin film. At final, the phosphor layer 44 is formed on portions of the surface of the anode portion 43 by spin-coating, for receiving the bombardment of electrons to generate light.

As the structure of the field emission lamp according to fourth embodiment of the present invention is similar to that of the field emission lamp according to second embodiment of the present invention, and the only difference between them are: the shape of the outer shell (tubular vs. bulb-like shape) and the shape of the mesh cathode portion (curving structure vs. bowl-like structure), the detail description regarding the operation of the field emission lamp according to fourth embodiment of the present invention, such as the mechanism of the generation of light, is omitted hereinafter.

Figure 5:
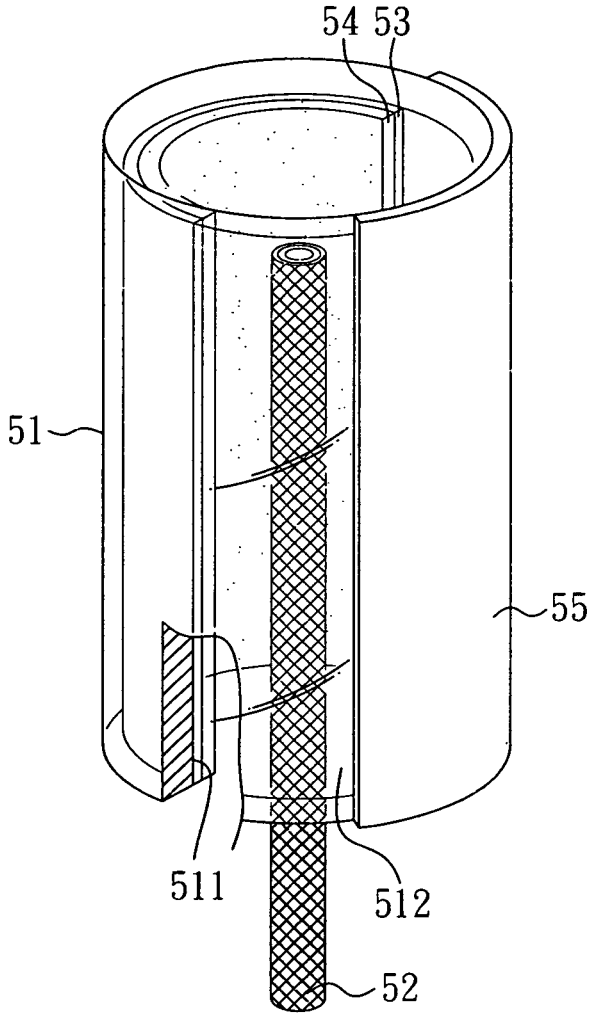
FIG. 5 is a perspective view of the field emission lamp according to fifth embodiment of the present invention.

With reference to FIG. 5, wherein FIG. 5 is a perspective view of the field emission lamp according to fifth embodiment of the present invention. The field emission lamp according to fifth embodiment of the present invention comprises: an outer shell 51, a mesh cathode portion 52, an anode portion 53, and a phosphor layer 54. Wherein, the outer shell 51 can be formed by a transparent material, for example, a soda-lime glass. Besides, the outer shell 51 has an inner surface 511, and the light generated by the phosphor layer 54, due to the bombardment of the electrons, outputs from the field emission lamp according to fifth embodiment of the present invention through the inner surface 511 of the outer shell 51 where none of the anode portion 53 is formed thereon.

However, as shown in FIG. 5, the field emission lamp according to fifth embodiment of the present invention further comprises a lens unit 55, and the lens unit 55 is formed on an outer surface 512 of the outer shell 51. Thus, when the field emission lamp according to fifth embodiment of the present invention is operating, the light generated by the phosphor layer 54, due to the bombardment of the electrons, outputs from the field emission lamp according to fifth embodiment of the present invention through the inner surface 511 of the outer shell 51 where none of the anode portion 53 is formed thereon, and then through the lens unit 55 to the exterior. The lens unit 55 can has a convex lens structure capable of concentrating light, such as a double convex lens or a flat-convex lens, or a concave structure capable of diffusing light, such as a double concave lens or a flat-concave lens. As a result, the field emission lamp according to fifth embodiment of the present invention can provide light suitable for different purpose. In other state of the present embodiment, the lens unit 55 is formed on the inner surface 511 of the outer shell 51 where none of the anode portion 53 is formed thereon.

As the structure of the field emission lamp according to fifth embodiment of the present invention is similar to that of the field emission lamp according to first embodiment of the present invention, and the only difference between them is the installation of the lens unit, the detail description regarding the operation of the field emission lamp according to fifth embodiment of the present invention, such as the mechanism of the generation of light, is omitted hereinafter.

Figure 6:
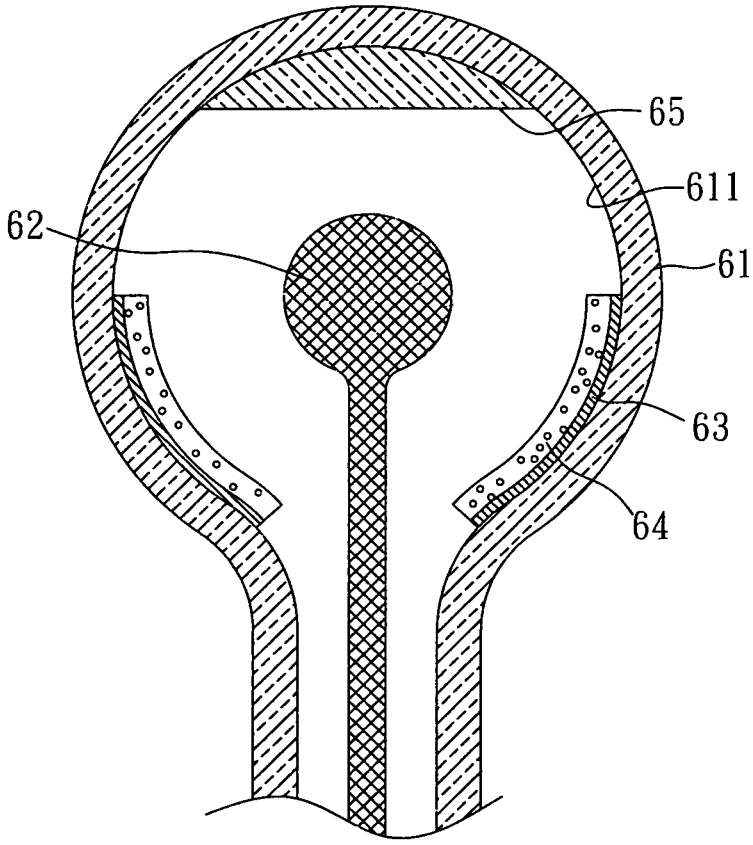
FIG. 6 is a perspective view of the field emission lamp according to sixth embodiment of the present invention.

With reference to FIG. 6, wherein FIG. 6 is a perspective view of the field emission lamp according to sixth embodiment of the present invention. The field emission lamp according to sixth embodiment of the present invention comprises: an outer shell 61, a mesh cathode portion 62, an anode portion 63, and a phosphor layer 64. Wherein, the outer shell 61 can be formed by a transparent material, for example, a soda-lime glass. Besides, the outer shell 61 has an inner surface 611, and the light generated by the phosphor layer 64, due to the bombardment of the electrons, outputs from the field emission lamp according to sixth embodiment of the present invention through the inner surface 611 of the outer shell 61 where none of the anode portion 63 is formed thereon.

However, as shown in FIG. 6, the field emission lamp according to sixth embodiment of the present invention further comprises a lens unit 65, and the lens unit 65 is formed inside the outer shell 61. Thus, when the field emission lamp according to sixth embodiment of the present invention is operating, the light generated by the phosphor layer 64, due to the bombardment of the electrons, passes through the lens unit 65 first, then outputs from the field emission lamp according to sixth embodiment of the present invention through the inner surface 611 of the outer shell 61 where none of the anode portion 63 is formed thereon. The lens unit 65 can has a convex lens structure capable of concentrating light, such as a double convex lens or a flat-convex lens, or a concave structure capable of diffusing light, such as a double concave lens or a flat-concave lens. As a result, the field emission lamp according to sixth embodiment of the present invention can provide light suitable for different purpose. In other state of the present embodiment, the lens unit 65 is formed on the outer surface of the outer shell 61.

As the structure of the field emission lamp according to sixth embodiment of the present invention is similar to that of the field emission lamp according to first embodiment of the present invention, and the only difference between them is the installation of the lens unit, the detail description regarding the operation of the field emission lamp according to sixth embodiment of the present invention, such as the mechanism of the generation of light, is omitted hereinafter.

Although the present invention has been explained in relation to its preferred embodiment, it is to be understood that many other possible modifications and variations can be made without departing from the spirit and scope of the invention as hereinafter claimed.

What is claimed is:

1. A field emission lamp comprising:

an outer shell having an inner surface;

a mesh cathode portion surrounded by the outer shell, wherein the mesh cathode portion has a tubular, spherical, curving or bowl-shaped structure;

an anode portion formed on a portion of the inner surface of the outer shell; and a phosphor layer formed on a portion of the anode portion;

wherein the light generated by the phosphor layer, due to the bombardment of the electrons, outputs from the field emission lamp through the inner surface of the outer shell where none of the anode portion is formed thereon.

2. The field emission lamp as claimed in claim 1, wherein the material of the outer shell is soda-lime glass, soda glass, boron-glass, flint glass, quartz glass, or alkali-free glass.

3. The field emission lamp as claimed in claim 1, wherein the shape of the outer shell is tubular.

4. The field emission lamp as claimed in claim 1, wherein the curving structure faces the anode portion.

5. The field emission lamp as claimed in claim 1, wherein the outer shell is a bulb-shaped shell.

6. The field emission lamp as claimed in claim 1, wherein the shape of the mesh cathode portion is a sphere.

7. The field emission lamp as claimed in claim 1, wherein the opening of the bowl-shaped structure faces the inner surface of the outer shell where none of the anode portion is formed thereon.

8. The field emission lamp as claimed in claim 1, wherein the anode portion is a metallic film.

9. The field emission lamp as claimed in claim 8, wherein the metallic film is aluminum film, nickel film, gold film, silver film, or tin film.

* * * * *